US009120322B2

(12) United States Patent
Okano et al.

(10) Patent No.: US 9,120,322 B2
(45) Date of Patent: Sep. 1, 2015

(54) INK JET RECORDING DEVICE

(71) Applicant: Hitachi Industrial Equipment Systems Co., Ltd., Chiyoda-ku, Tokyo (JP)

(72) Inventors: Mamoru Okano, Tokyo (JP); Tomohiro Inoue, Tokyo (JP); Akira Miyao, Tokyo (JP); Takahiro Arima, Tokyo (JP); Mitsuo Igari, Tokyo (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 0 days.

(21) Appl. No.: 13/944,965

(22) Filed: Jul. 18, 2013

(65) Prior Publication Data

US 2014/0043413 A1 Feb. 13, 2014

(30) Foreign Application Priority Data

Aug. 7, 2012 (JP) ..... 2012-174729

(51) Int. Cl.

| | |
|---|---|
| ***B41J 2/185*** | (2006.01) |
| ***B41J 2/165*** | (2006.01) |
| ***B41J 2/105*** | (2006.01) |
| ***B41J 2/215*** | (2006.01) |
| ***B41J 2/19*** | (2006.01) |
| ***B41J 2/17*** | (2006.01) |
| ***B41J 2/18*** | (2006.01) |
| *B41J 2/175* | (2006.01) |
| *B41J 2/03* | (2006.01) |

(52) U.S. Cl.

CPC .. *B41J 2/185* (2013.01); *B41J 2/18* (2013.01); *B41J 2/19* (2013.01); *B41J 2/17596* (2013.01); *B41J 2002/031* (2013.01); *B41J 2002/1853* (2013.01); *B41J 2002/1856* (2013.01)

(58) Field of Classification Search

None

See application file for complete search history.

(56) References Cited

U.S. PATENT DOCUMENTS

| | | | | |
|---|---|---|---|---|
| 4,068,241 | A * | 1/1978 | Yamada | 347/75 |
| 4,204,215 | A * | 5/1980 | Nakarai | 347/86 |
| 4,272,772 | A * | 6/1981 | Geil | 347/30 |
| 4,283,730 | A * | 8/1981 | Graf | 347/82 |
| 4,929,963 | A * | 5/1990 | Balazar | 347/89 |
| 4,961,082 | A * | 10/1990 | Hoisington et al. | 347/92 |
| 6,474,781 | B1 * | 11/2002 | Jeanmaire | 347/47 |
| 6,491,362 | B1 * | 12/2002 | Jeanmaire | 347/15 |
| 6,554,410 | B2 * | 4/2003 | Jeanmaire et al. | 347/77 |
| 6,739,705 | B2 * | 5/2004 | Jeanmaire et al. | 347/77 |

(Continued)

FOREIGN PATENT DOCUMENTS

| | | | |
|---|---|---|---|
| EP | 1338422 | A2 * | 8/2003 |
| JP | 60-11364 | A | 1/1985 |

(Continued)

*Primary Examiner* — Julian Huffman
*Assistant Examiner* — Leonard S Liang
(74) *Attorney, Agent, or Firm* — Crowell & Moring LLP

(57) ABSTRACT

An ink that is unused for printing when a supply ink from an ink container is ejected from a nozzle, and printing is conducted on an object to be printed is sucked by a gutter together with an air, and the ink and air are recovered into the ink container. In this situation, the air mixed with an ink solvent and recovered is discharged as an exhaust gas from the ink container by an exhaust path, and at this time, the ink mist is removed from the exhaust gas in which a liquefaction ink solvent liquefied within the exhaust path and the ink mist are mixed together by an ink mist mixture unit. Thereafter, the liquid is held by the aid of a capillary action, and separated from the gas in a gas-liquid separator to recover the separated liquefaction ink solvent.

9 Claims, 11 Drawing Sheets

(56) References Cited

U.S. PATENT DOCUMENTS

| | | | | |
|---|---|---|---|---|
| 6,746,108 | B1 * | 6/2004 | Jeanmaire | 347/82 |
| 6,840,610 | B2 * | 1/2005 | Taniguchi et al. | 347/86 |
| 6,851,796 | B2 * | 2/2005 | Jeanmaire et al. | 347/74 |
| 6,866,370 | B2 * | 3/2005 | Jeanmaire | 347/77 |
| 7,416,294 | B2 * | 8/2008 | Kojima | 347/92 |
| 7,682,002 | B2 * | 3/2010 | Brost et al. | 347/77 |
| 8,672,449 | B2 * | 3/2014 | Arima et al. | 347/34 |
| 2002/0085073 | A1 * | 7/2002 | Chwalek et al. | 347/77 |
| 2003/0063166 | A1 * | 4/2003 | Jeanmaire et al. | 347/77 |
| 2006/0139418 | A1 * | 6/2006 | Udagawa | 347/85 |
| 2007/0006735 | A1 * | 1/2007 | Olsen | 96/188 |
| 2007/0052782 | A1 * | 3/2007 | Lee | 347/97 |
| 2008/0018718 | A1 * | 1/2008 | Ishizawa et al. | 347/86 |
| 2008/0036806 | A1 * | 2/2008 | Shinada et al. | 347/9 |
| 2009/0167829 | A1 * | 7/2009 | Iijima | 347/92 |
| 2011/0285786 | A1 * | 11/2011 | Sekiya | 347/34 |
| 2012/0200622 | A1 * | 8/2012 | Inoue et al. | 347/6 |

FOREIGN PATENT DOCUMENTS

| | | | |
|---|---|---|---|
| JP | 2003-4343 | A | 1/2003 |
| JP | 2006-26620 | A | 2/2006 |
| JP | 2009-172932 | A | 8/2009 |
| WO | WO 2012/111039 | A1 | 8/2012 |

* cited by examiner

INK JET RECORDING DEVICE

BACKGROUND

The present invention relates to an ink jet recording device that continuously ejects an ink from a nozzle, and conducts printing on an object to be printed.

One of the ink jet recording devices is of a continuous system in which the ink is continuously ejected from the nozzle, ejected ink particles which are flying are charged, and the charged ink particles are further deflected by an electric field for conducting printing. The ink jet recording device of this system has been extensively popularized for an intended purpose of printing numbers or codes on metal cans or plastic surfaces.

As a related art of this type, there is an ink jet recording device disclosed in Japanese Unexamined Patent Application Publication No. 2009-172932. The ink jet recording device includes a main body, a recording head, and a conduit that couples the main body to the recording head. The main body includes an ink container that stores the ink therein, an ink supply pump that the ink to the recording head from the ink container, a recovery pump that recovers the ink into the ink container from the recording head, and a control unit that controls the operation of the recording device.

The recording head includes a nozzle that ejects the ink supplied from the main body as the ink particles, an electrification electrode that allows the ink particles to be charged, and a deflection electrode that allows the charged ink to be deflected by an electrostatic field, and a gutter that traps unused ink. A tube into which the ink flows, and an electric wiring that transmits an electric signal to the recording head are inserted through the conduit that couples the main body to the recording head.

In the ink jet recording device of this continuous system, a solvent high in volatility such as methyl ethyl ketone or ethanol is used for an ink solvent in order to conduct printing at high speed. Also, when the ink is recovered by the recovery pump, a surrounding air is also sucked from the gutter together with the ink. Because the sucked air is continuously fed to the ink container, there is a need to discharge the air from the ink container.

However, since the volatilized solvent is included in the air sucked together with the ink, if the air sucked from the gutter is discharged out of the ink jet recording device, the ink solvent is also discharged. For that reason, the environment is subject to a load, and the running costs are increased.

Under the circumstances, in order to prevent the ink solvent discharged out of the inkjet recording device from being volatilized, Japanese Unexamined Patent Application Publication No. Sho 60 (1985)-11364 discloses an ink jet recording device having an exhaust line that supplies the air discharged from the ink container to the gutter. In this ink jet recording device, since the exhaust gas is supplied to the gutter, the exhaust gas circulates within the inkjet recording device, and the amount of volatilization of the ink solvent can be reduced. An interior of the main body in which the ink container is present becomes higher in temperature than an interior of the recording head by about 10 to 20° C. For that reason, there is a case in which a temperature of the exhaust gas drops, and the solvent is liquefied while the exhaust gas is being fed to the gutter.

For that reason, there is a need to separate a liquid from the exhaust gas, and as a separation technique thereof, there is a gas-liquid separation device disclosed in Japanese Unexamined Patent Application Publication No. 2003-4343 in which a liquid component that drops by gravity is recovered.

Also, a fine ink mist is mixed in the exhaust gas from the ink container in the ink jet recording device. The ink mist is generated when the ink is recovered from the gutter together with the air. When the exhaust gas is supplied from the ink container to the gutter, the interior of the recording head is dirtied by the ink mist in the exhaust gas. Under the circumstances, as a method of removing the ink mist included in the gas, there is a method of removing a foreign matter from an air disclosed in Japanese Unexamined Patent Application Publication No. 2006-26620.

As illustrated in FIG. 14, the foreign matter removal method is realized by a configuration in which a gas containing a mist is inserted from an inlet 80, and introduced into a solution 82 contained in a container 81, the introduced gas is formed into bubbles 85 by a fine bubble generation unit 83, and discharged into the solution 82, and further the gas as the bubbles 85 goes out an outlet 86. In this configuration, an obstacle unit 84 is present within the solution 82 so that the bubbles 85 cannot easily float. With this configuration, the ink mist is allowed to remain in the solution 82 to enable the removal of the ink mist.

SUMMARY

As described above, when there is used the inkjet recording device disclosed in Japanese Unexamined Patent Application Publication No. Sho 60 (1985)-11364, a temperature of the exhaust gas may drop to liquefy the ink solvent while the exhaust gas is being fed to the gutter. That is, a saturated vapor pressure increases more as the ink solvent becomes higher in temperature. Therefore, as the usage environment of the ink jet recording device is higher in the temperature, the ink solvent is condensed and liquefied even if the temperature slightly drops from a high temperature state. When the ink solvent liquefied in the vicinity of the gutter spills on the circumference, there is a risk that the interior of the recording head is dirtied. Also, when the liquefied solvent collides with the ink particles used for printing, there is a risk that the printing quality is adversely affected.

For that reason, there is a need to remove the solvent liquefied in the exhaust gas. Under the circumstances, a liquid component is separated from the gas with which the liquid is mixed, by the gas-liquid separation device disclosed in Japanese Unexamined Patent Application Publication No. 2003-4343. However, since the gas-liquid separation device is configured to recover the liquid component that has dropped by the gravity, there arises such a problem that the gas and the liquid cannot be separated from each other if an installation direction of the gas-liquid separation device is changed.

Also, when the fine ink mist contained in the exhaust gas is separated and removed through the method disclosed in Japanese Unexamined Patent Application Publication No. 2006-26620, since the removed ink mist component remains in the solution 82, the solution 82 must be regularly replaced with fresh one. For that reason, there arises such a problem that time and effort are required, and the high expensive costs occur.

The present invention has been made in view of the above circumstances, and aims at providing an ink jet recording device which is capable of appropriately separating an ink solvent liquefied within an exhaust path from an exhaust gas, preventing an interior of a recording head from being dirtied when the separated exhaust gas returns to the interior of the recording head, and realizing this function at low running costs.

In order to address the above problem, according to an aspect of the present invention, there is provided an ink jet recording device, including: an ink container that stores an ink therein; a nozzle that ejects the ink, and conducts printing on an object to be printed; an ink supply pump that supplies the ink to the nozzle from the ink container through an ink supply path; a gutter that sucks the ink ejected from the nozzle and not used for the printing together with an air; a first recovery pump that feeds the ink sucked by the gutter to the ink container through an ink recovery path together with the air to recover the ink; an exhaust path that exhausts the air mixed with an ink solvent and is recovered in the ink container from the ink container as the exhaust gas; a gas-liquid separator that holds a liquefaction ink solvent in which the ink solvent in the exhaust gas is liquefied within the exhaust path by a capillary action to separate the liquefaction ink solvent from the exhaust gas containing only the gas; and a second recovery pump that feeds the liquefaction ink solvent separated by the gas-liquid separator to the ink container through a separated ink recovery path.

According to the aspect of the present invention, there can be provided the inkjet recording device which is capable of appropriately separating an ink solvent liquefied within an exhaust path from an exhaust gas, preventing an interior of a recording head from being dirtied when the separated exhaust gas returns to the interior of the recording head, and realizing this function at low running costs.

BRIEF DESCRIPTION OF THE DRAWINGS

FIGS. 5A and 5B illustrate a configuration of a gas-liquid separator, in which FIG. 5A is an external perspective view of a gas-liquid separator, and FIG. 5B is a cross-sectional view taken along a line A1-A1 when the gas-liquid separator of FIG. 5A is taken along the longitudinal direction;

DETAILED DESCRIPTION

Hereinafter, an embodiment of the present invention will be described with reference to the accompanying drawings.

(Configuration of Embodiment)

Figure 1:
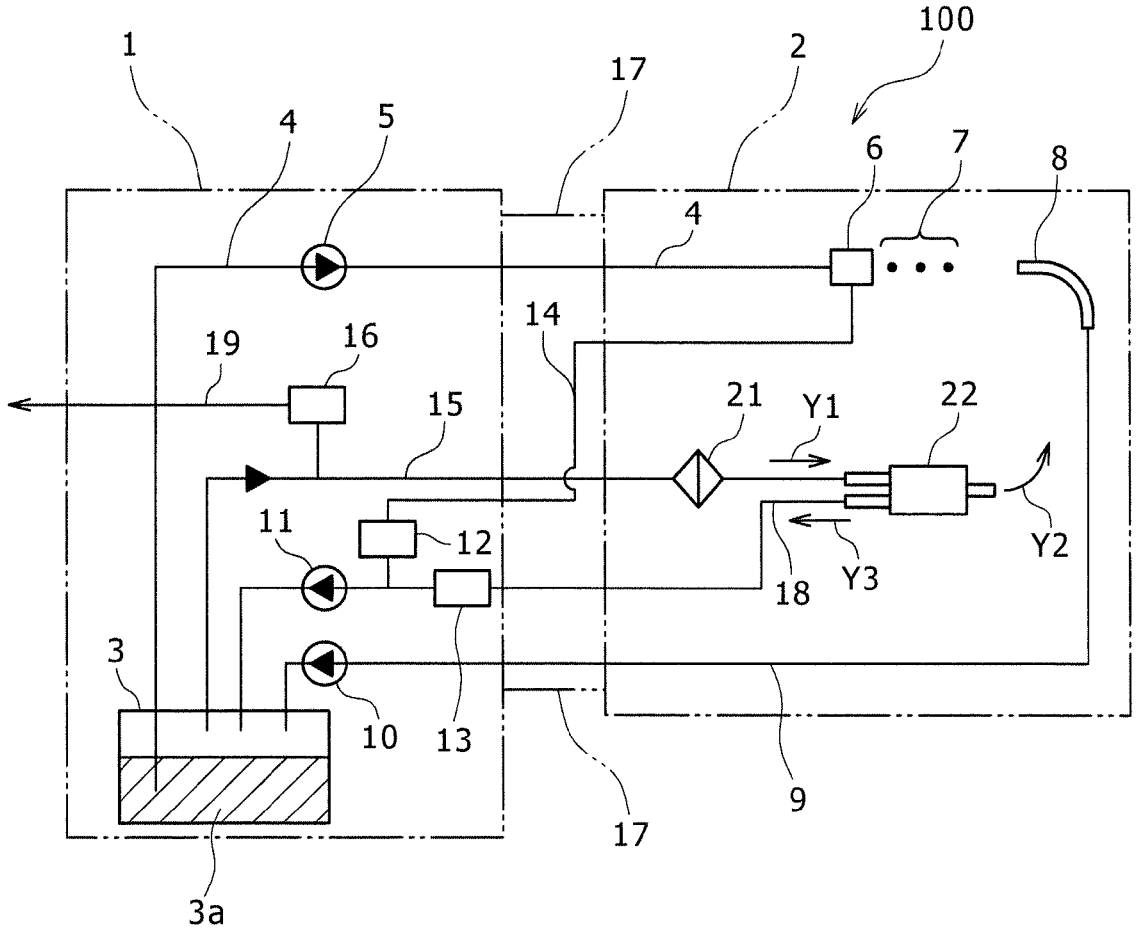
FIG. 1 is a configuration illustrating a configuration of an ink jet recording device according to an embodiment of the present invention.

FIG. 1 is a diagram illustrating a configuration of an ink jet recording device 100 according to an embodiment of the present invention. As illustrated in FIG. 1, the ink jet recording device 100 includes a main body 1, a recording head 2, and a conduit 17 that connects the main body 1 and the recording head 2.

The main body 1 includes an ink container 3, an ink supply pump 5, recovery pumps (first and second recovery pumps) 10, 11, electro-magnetic valves 12, 13, 16, and an ink supply path 4, an ink recovery path 9, a cleaning path 14, an exhaust path 15, a separated ink recovery path 18, and a bypass path 19, which are paths formed of piping, pipes, or tubes.

The recording head 2 includes a nozzle 6, a gutter 8, an ink mist mixture unit 21, a gas-liquid separator 22, the ink supply path 4, the ink recovery path 9, the cleaning path 14, the exhaust path 15, the separated ink recovery path 18, and the bypass path 19. The conduit 17 is a pipe that connects the main body 1 and the recording head 2, and houses the ink supply path 4, the ink recovery path 9, the cleaning path 14, the exhaust path 15, the separated ink recovery path 18, and the bypass path 19 as well as electric wirings not shown therein. The conduit 17 is expressed as a short length in FIG. 1, but is an accordion pipe as long as about 4 m in a real device of the ink jet recording device 100.

<Basic Configuration and Basic Operation of Embodiment>

Figure 2:
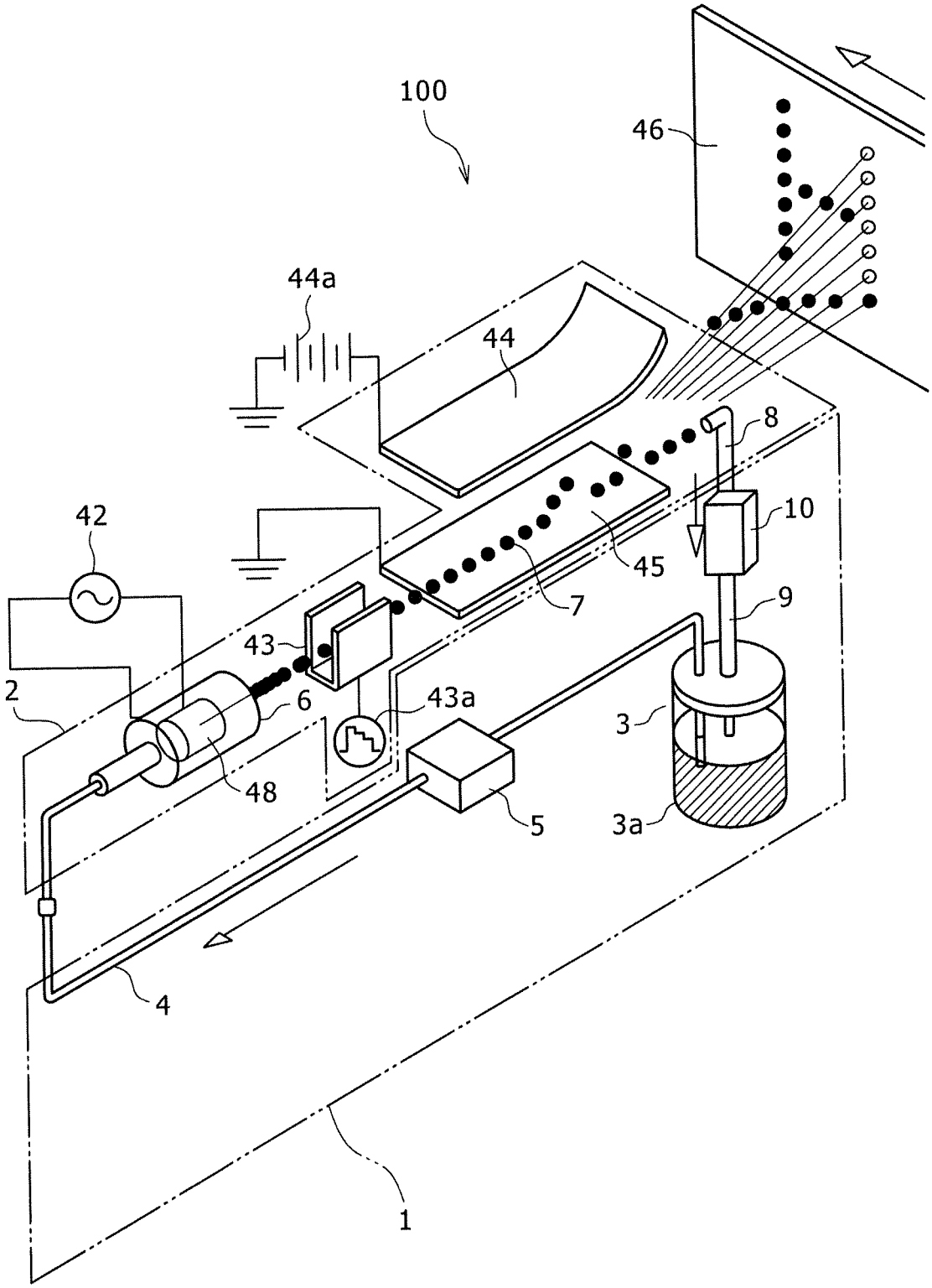
FIG. 2 is a perspective view illustrating a basic configuration of the ink jet recording device illustrated in FIG. 1.

A basic configuration and basic operation of the ink jet recording device 100 having the above components will be described with reference to FIG. 2. FIG. 2 is a perspective view illustrating a basic configuration of the inkjet recording device 100 illustrated in FIG. 1.

The ink container 3 stores an ink 3*a* therein, and is connected to the nozzle 6 through ink supply pump 5 by the ink supply path 4. The ink supply pump 5 supplies the ink 3*a* within the ink container 3 to the nozzle 6 while pumping the ink 3*a* within the ink supply path 4. Although not shown, the ink supply path 4 includes a regulating valve that regulates an ink pressure, a pressure indicator that indicates a pressure of the supply ink, and a filter that catches a foreign matter in the ink.

The nozzle 6 includes a piezoelectric element 48, and a high-frequency sine wave is supplied to the piezoelectric element 48 from a power supply 42 to eject the ink from a recessed orifice (not shown) at a termination of the nozzle 6. The ejected ink is split into particles 7 while flying, and output to a U-shaped electrification electrode 43. The electrification electrode 43 is connected with a recording signal source 43*a*, and a recording signal voltage is applied to the electrification electrode 43 from the recording signal source 43*a* to charge ejected particles 7 from the nozzle 6, and the charged ink particles 7 are output between an upper deflection electrode 44 and a ground electrode 45.

The upper deflection electrode 44 is connected to a high voltage source 44*a*, and the ground electrode 45 is grounded. Therefore, an electrostatic field is formed between the upper deflection electrode 44 and the ground electrode 45. Therefore, when the charged ink particles 7 pass through the electrostatic field between the upper deflection electrode 44 and the ground electrode 45, the ink particles 7 are deflected according to an electric charge amount of the ink particles 7 per se, and the deflected ink particles 7 are adhered onto a recording medium 46 to print an image or a character. In FIG. 2, an ejection direction of the ink particles 7 is horizontal, but the ink particles 7 can be ejected in a vertical direction for printing.

Incidentally, the ink particles 7 that have not been deflected while passing through the electrostatic field are recovered by the gutter 8 having a recovery port together with the air. That is, the gutter 8 is guided into the ink container 3 by the ink recovery path 9 which is halfway connected with the recovery pump (first recovery pump) 10. The ink particles 7 are sucked from the gutter 8 by the aid of a suction of the recovery pump 10 together with the ink particles 7, and recovered into the ink container 3. The recovered ink particles 7 are recycled.

Also, the ink particles 7 and the air are mixed together and fed within the ink recovery path 9. However, since a solvent (ink solvent) of the ink particles 7 is high in volatility, a part of ink solvent is volatilized during feeding, and mixed with the air. Also, when the ink particles 7 and the air are mixed together and fed, atomized ink mist is generated within the ink recovery path 9. Further, since the ink particles 7 are spewed into the ink container 3 together with the air on an outlet of the ink recovery path 9 within the ink container 3, the ink mist is generated. Also, because the air sucked by the recovery pump 10 continues to be fed into the ink container 3, there is a need to discharge the air from the interior of the ink container 3.

<Characterized Configuration of Embodiment>

In this embodiment, in FIG. 1, the air that is accumulated in the ink container 3 passes through the exhaust path 15 as indicated by an arrow Y1, and is fed to the gas-liquid separator 22 that separates the air and the liquid from each other through the ink mist mixture unit 21 which will be described later. The liquid and the gas contained in the air are separated from each other in the gas-liquid separator 22, and the exhaust gas containing only the gas is discharged as indicated by an arrow Y2. The exhaust gas is sucked by the gutter 8. An outlet of the exhaust gas in the gas-liquid separator 22 is arranged toward a recovery port of the gutter 8 so that the gutter 8 can efficiently suck the exhaust gas. Also, an exhaust side of the liquid of the gas-liquid separator 22 indicated by an arrow Y3 is introduced into the ink container 3 through the separated ink recovery path 18. The electro-magnetic valve 13 and the recovery pump (second recovery pump) 11 are inserted halfway into the separated ink recovery path 18 in the stated order.

The orifice disposed on the termination of the nozzle 6 is connected to an input side of the recovery pump 11 of the separated ink recovery path 18 through the cleaning path 14, and the electro-magnetic valve 12 is inserted between this connection portion and the orifice. Further, the bypass path 19 is connected to the middle of the exhaust path 15 led from the ink container 3, through the electro-magnetic valve 16 in a branched state. The bypass path 19 discharges the exhaust gas to the external of the ink jet recording device 100.

In the above configuration, in a state where the ink particles 7 are mixed with the air, and sucked by the recovery pump 10 through the gutter 8, the mixed air continuously fed into the ink container 3 is separated into the liquid and the exhaust gas of the air by the gas-liquid separator 22 through the exhaust path 15, and the exhaust gas is returned to the gutter 8. As a result, the amount of volatilization (or the amount of leakage) of the ink solvent toward the external of the ink jet recording device 100 can be reduced, and this action makes it possible to reduce the environmental load.

Also, the interior of the main body 1 in which the ink container 3 is arranged becomes higher than the interior of the recording head 2 by about 10 to 20° C. due to a heat generated by a circuit board not shown. Therefore, the exhaust gas that passes through the exhaust path 15 in the main body 1 may be cooled before the exhaust gas is fed into the gutter 8 within the recording head 2 to liquefy the ink solvent mixed with the exhaust gas. When the ink solvent is liquefied, the liquefaction ink solvent is separated by the gas-liquid separator 22, and returned to the ink container 3. This makes it possible to reduce the amount of volatilization of the ink solvent toward the external of the ink jet recording device 100.

In general, the exhaust gas is more cooled as the path through which the exhaust gas passes is longer, and the volatilized ink solvent is easily liquefied and easily recovered. Under the circumstances, in this embodiment, the gas-liquid separator 22 that discharges the exhaust gas is arranged in the vicinity of the gutter 8 farthest from the ink container 3 to lengthen the exhaust path 15 between the ink container 3 and the gas-liquid separator 22.

Also, when the nozzle 6 is clogged, a clogged material is sucked from the orifice of the nozzle 6 through the cleaning path 14, and recovered into the ink container 3 through the sucking operation of the recovery pump 11 after the electro-magnetic valve 13 has been closed, and the electro-magnetic valve 12 has been opened. In this structure, the clog of the orifice is easily eliminated when an operator of the ink jet recording device 100 conducts the recovery operation while supplying the solvent to the orifice.

Incidentally, as described above, since the interior of the main body 1 in which the ink container 3 is arranged becomes higher than the interior of the recording head 2 by about 10 to 20° C., the temperature of the exhaust gas within the main body 1 becomes substantially equal to the temperature of the interior of the ink container 3. Also, the exhaust gas within the exhaust path 15 in the main body 1 is brought into a state in which three components of the air, the volatilized ink solvent, and the ink mist are mixed together (also called "mixture exhaust gas" or "gas-liquid mixture"). If the mixture exhaust gas is returned to the interior of the recording head 2 as it is, the ink solvent volatilized toward the external of the ink jet recording device 100 is difficult to discharge. Therefore, the amount of volatilization of the ink solvent toward the external can be reduced.

Figure 3:
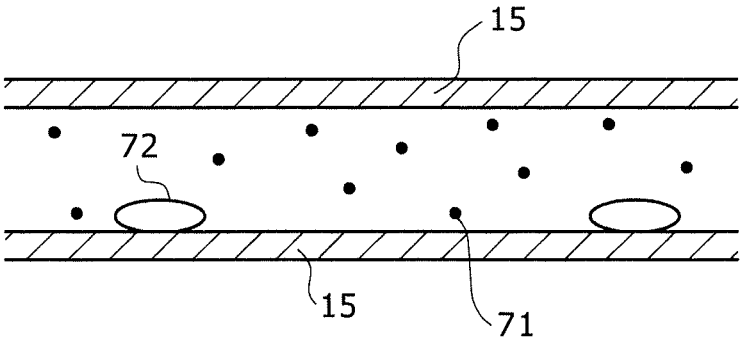
FIG. 3 is a partially cross-sectional view taken along a longitudinal direction of the exhaust path.

However, since the temperature of the exhaust path 15 drops within the conduit 17, a part of the ink solvent is liquefied (liquefaction ink solvent 72). FIG. 3 is a partially cross-sectional view taken along a longitudinal direction of the exhaust path 15. When the liquefaction ink solvent 72 is returned to the interior of the recording head 2 as it is, the interior of the recording head 2 is contaminated, or the liquefaction ink solvent 72 comes in contact with the flying ink particles 7 to degrade the printing quality. Also, since ink mist 71 is also mixed within the exhaust path 15, even if the liquefaction ink solvent 72 is returned to the interior of the recording head 2 without removing the ink mist 71, the interior of the recording head 2 is contaminated.

The ink mist 71 moves together with the exhaust gas within the exhaust path 15, and its speed is about 1.5 to 2.0 m/s. The liquefaction ink solvent 72 travel along an inner wall of the exhaust path 15, and its travel speed is changed according to an installation direction of the exhaust path 15, but is about 1/10 to 1/30 of a travel speed of the ink mist 71. The amount of the liquefaction ink solvent 72 falls within about 1 to 10 g/h depending on the temperature of the ink container (temperature of the ink container 3 is 0 to 50° C.). Under the circumstances, in this embodiment, the ink mist 71 is removed by the ink mist mixture unit 21, and the liquefaction ink solvent 72 is separated from the exhaust gas by the gas-liquid separator 22.

<Configuration of Ink Mist Mixture Unit 21>

First, as a method of removing the ink mist 71, it is generally conceivable to provide a stainless filter that is not affected by the ink solvent in the middle of the exhaust path 15. However, in the case of a plate-like stainless filter, even if the ink mist 71 that flies at a high speed is caught by a mesh of the filter, the ink mist 71 is blown out by a flow of air coming later. Therefore, it is difficult to remove the ink mist 71 without depending on the fineness of the mesh.

Under the circumstances, attention is focused on a fact that since a small amount of liquefaction ink solvent 72 flows in the exhaust path 15, if the ink mist 71 can be mixed with the liquefaction ink solvent 72, the ink mist 71 in the exhaust gas can be removed, and the ink mist mixture unit 21 is configured.

Figure 4:
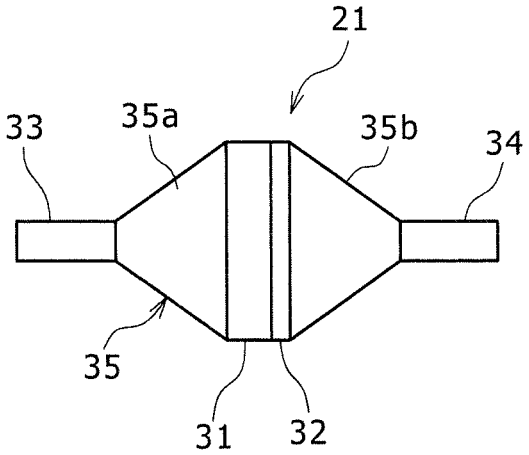
FIG. 4 is a diagram illustrating a configuration of an ink mist mixture unit.

FIG. 4 is a diagram illustrating a configuration of the ink mist mixture unit 21. The ink mist mixture unit 21 includes a disc-shaped liquid holding part 31 containing a liquid therein, and a disc-shaped filter 32 that catches a fine material generated from the liquid holding part 31, which is joined to the liquid holding part 31 on the respective circular surfaces. Further, the ink mist mixture unit 21 includes a case 35 that houses the joined liquid holding part 31 and filter 32 in such a manner that the liquid holding part 31 and the filter 32 are sandwiched by corn shaped containers 35*a* and 35*b* each having an opened top from both sides. An opening of one corn shaped container 35*a* of the case 35 is connected to the exhaust path 15 on the ink container 3 side by a cylindrical terminal area 33, and an opening of the corn shaped container 35*b* is connected to the exhaust path 15 on the gas-liquid separator 22 side by a cylindrical terminal area 34.

The liquid holding part 31 includes a sheet which is made of PTFE (polytetrafluoroethylene) insoluble in the ink solvent, or stainless steel knitted into strings, and has properties that is high in air permeability and holds the liquid within the sheet.

Also, it is preferable that the ink mist mixture unit 21 is arranged at a position where the ink solvent in the exhaust gas is easily liquefied, that is, arranged immediately before an exhaust gas inlet (arrow Y1 side in FIG. 1) of the gas-liquid separator 22. The ink mist 71 in the gas-liquid mixture is mixed with the liquefaction ink solvent 72 when passing through the liquid holding part 31 wetted with the liquefaction ink solvent 72 within the exhaust path 15. Also, since the liquefaction ink solvent 72 is continuously replenished to the liquid holding part 31 through the exhaust path 15, the ink mist 71 is not firmly fixed to the liquid holding part 31.

<Configuration of Gas-Liquid Separator 22>

Figure 5A:
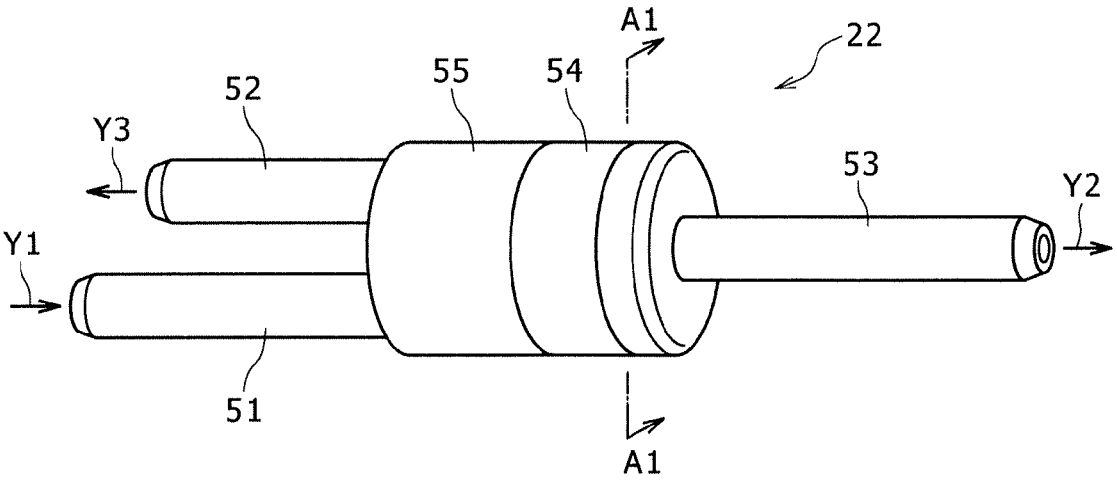
Figure 5B:
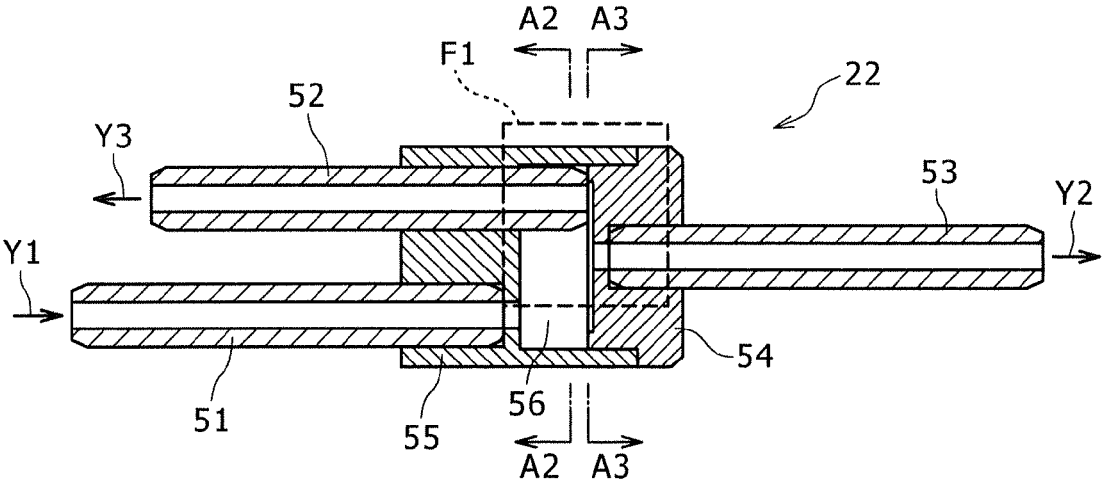
Figure 6A:
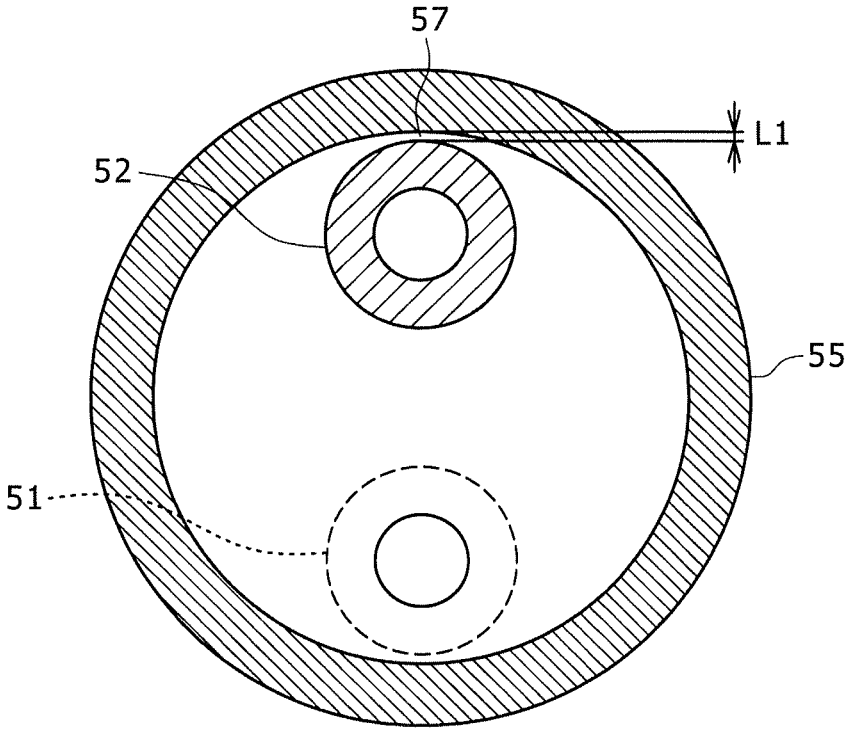
FIG. 6A is a cross-sectional view taken along a line A2-A2 in FIG. 5B.
Figure 6B:
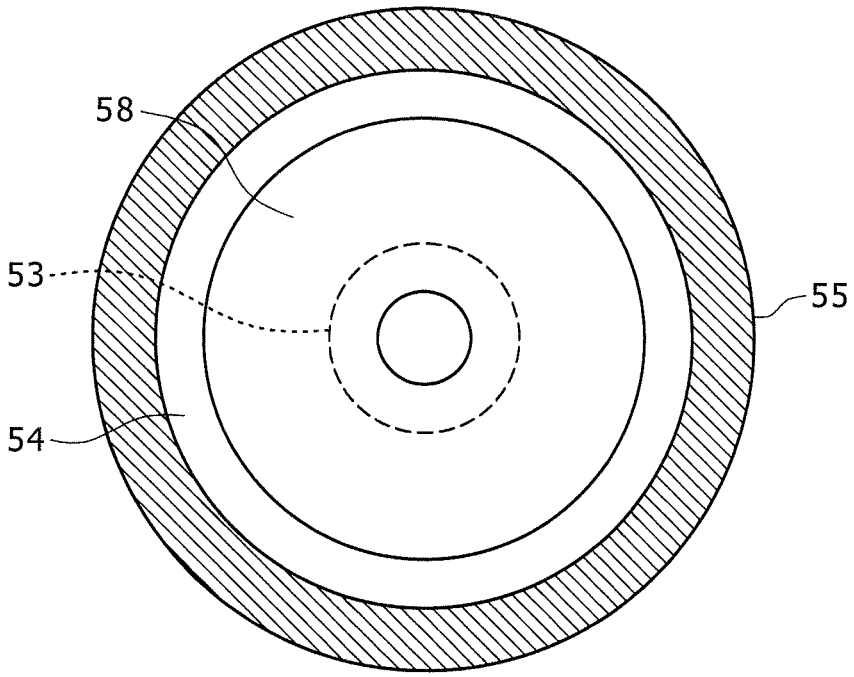
FIG. 6B is a cross-sectional view taken along a line A3-A3 in FIG. 5B.

Subsequently, a description will be given of the gas-liquid separator 22 that separates the liquefaction ink solvent 72 from the exhaust gas. FIGS. 5A and 5B illustrate a configuration of the gas-liquid separator 22, in which FIG. 5A is an external perspective view of the gas-liquid separator 22, and FIG. 5B is a cross-sectional view taken along a line A1-A1 when the gas-liquid separator of FIG. 5A is taken along the longitudinal direction. FIG. 6A is a cross-sectional view taken along a line A2-A2 in FIG. 5B, and FIG. 6B is a cross-sectional view taken along a line A3-A3 in FIG. 5B. As illustrated in FIGS. 5A and 5B, the gas-liquid separator 22 is configured such that a cylindrical gas-liquid inflow tube 51 and a cylindrical gas-liquid outflow tube 52 each having a circular cross-section are fitted into corresponding two insertion holes of a columnar case 55, and a cylindrical exhaust tube 53 having a circular cross-section is fitted into a center through-hole of a columnar case 54 having a convex fitted to a concave in the other end side of the case 55.

The gas-liquid inflow tube 51 is joined to the exhaust path 15 illustrated in FIG. 1, and a gas-liquid mixture in which the ink mist 71 and the liquefaction ink solvent 72 are mixed with the exhaust gas within the exhaust path 15 inflows in a direction indicated by the arrow Y1. The gas-liquid outflow tube 52 is joined to the separated ink recovery path 18 illustrated in FIG. 1, and the liquefaction ink solvent 72 separated by the gas-liquid separator 22 outflows in a direction indicated by an arrow Y3. In the exhaust tube 53, the exhaust gas including only the gas separated by the gas-liquid separator 22 is discharged into the recording head 2 as indicated by an arrow Y2.

Figure 7:
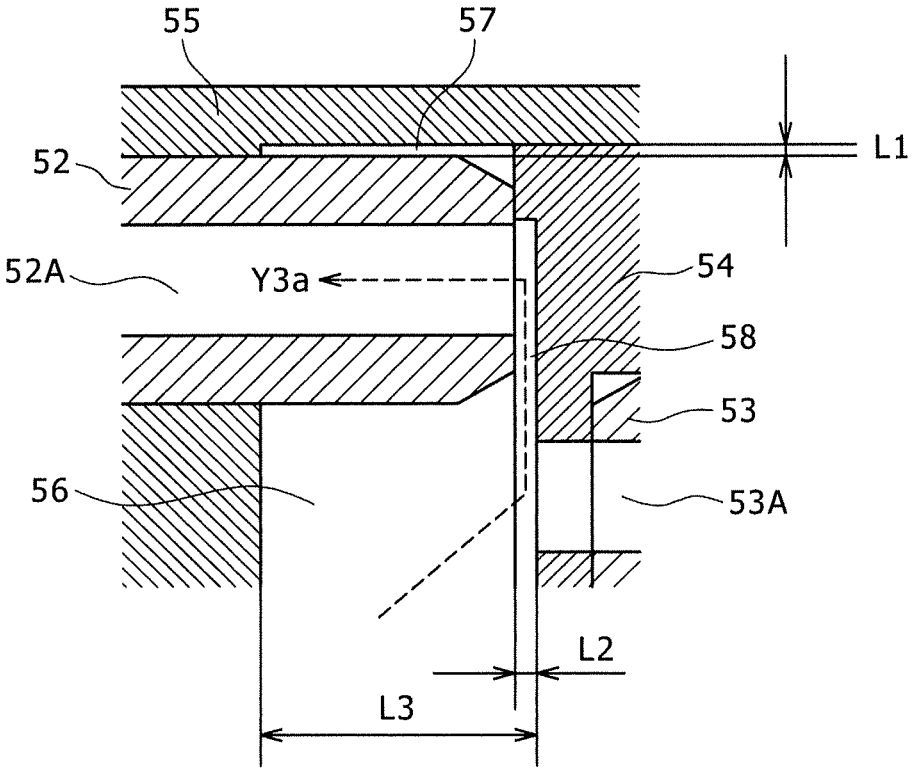
FIG. 7 is a partially cross-sectional view illustrating a gas-liquid separation structure of the gas-liquid separator.

The cases 54 and 55 are coupled together in gas-liquid flowing directions indicated by the arrows Y1 to Y3 to form a hollow chamber 56. An enlarged diagram of a portion including the chamber 56 surrounded by a dashed frame F1 is illustrated in FIG. 7. FIG. 7 is a partially cross-sectional view illustrating a gas-liquid separation structure of the gas-liquid separator 22.

As illustrated in FIG. 7, a gap 57 having an interval L1 is formed between an outer peripheral surface of the gas-liquid outflow tube 52 and an inner wall of the case 55. An end surface of the case 54 against which an inlet of the gas-liquid outflow tube 52 is abutted is formed with a step 58 that is circularly recessed. As illustrated in FIG. 6B, the step 58 is circularly recessed in a circular end surface of the convex of the case 54, which is fitted into the concave of the case 55. In more detail, the step 58 is circularly recessed concentrically with respect to an exhaust gas path 53A of the exhaust tube 53 fitted to the center of the case 54. When viewed from a side surface of the exhaust gas path 53A, the step 58 has a gap indicated by an L2 in FIG. 7. The step 58 makes it easy to discharge the liquefaction ink solvent 72 in the gas-liquid mixture to a path 52A within the gas-liquid outflow tube 52 as indicated by an arrow Y3*a*.

As illustrated in FIG. 7, the chamber 56 has a length of an interval L3 in the gas-liquid flowing direction as illustrate in FIG. 7, and the gas-liquid mixture flows into the chamber 56 from the gas-liquid inflow tube 51 as indicated by the arrow Y1 (refer to FIG. 5B). A liquid component within the gas-liquid mixture passes through the step 58 by a capillary action, and is held by the gap 57. Because the liquid component is thus held, the liquid does not approach the exhaust tube 53. As illustrated in FIGS. 7 and 6A, the gap 57 is formed with the interval L1 between the outer peripheral surface of the gas-liquid outflow tube 52 and the inner peripheral surface (inner wall) of the case 55. A holding force of the liquid within the gap 57 becomes larger as the interval L1 is narrow. Therefore, if the interval L1 is narrowed, the gas-liquid separation can be performed regardless of an installation posture of the gas-liquid separator 22.

That is, the liquefaction ink solvent 72 within the gas-liquid mixture which has flown into the gas-liquid separator 22 from the gas-liquid outflow tube 52 as indicated by the arrow Y3 passes through the step 58 as indicated by the arrow Y3*a*, is sent to the gas-liquid outflow tube 52 while being held by the gap 57 having the interval L1, and recovered into the ink container 3.

Figure 8:
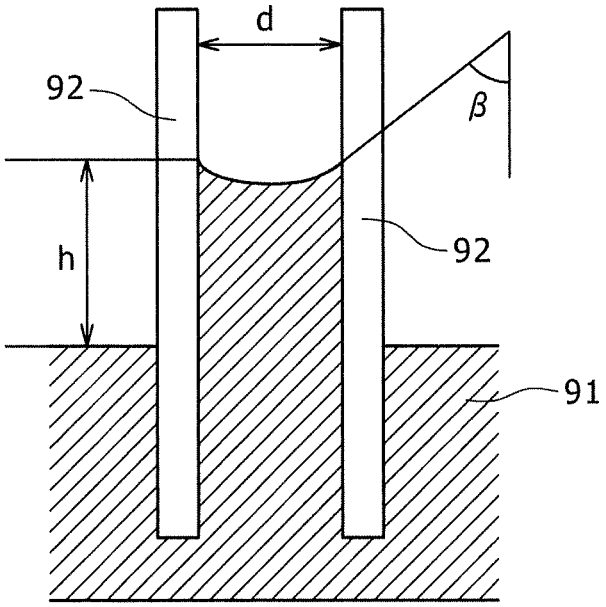
FIG. 8 is a diagram illustrating a relationship between an interval of a gap between an outer peripheral surface of a gas-liquid inflow tube and an inner wall of a case in the gas-liquid separator, and a holding force of a liquid.

A relationship between the interval L1 of the gap 57 and the holding force will be described with reference to FIG. 8. FIG. 8 is a diagram illustrating a relationship between the interval L1 of the gap 57 between the outer peripheral surface of the gas-liquid inflow tube 52 and the inner wall of the case 55 in the gas-liquid separator 22, and the holding force of the liquid.

A liquid 91 goes up to a height h by the capillary action, between two flat planes 92 separated from each other at an interval d and erected within the liquid 91. In this case, when it is assumed that a surface tension of the liquid 91 is Γ, a contact angle between the liquid 91 and the flat planes 92 is β, a density of the liquid 91 is ρ, and a gravity acceleration is g, the height h is represented by the following Expression (1).

$$h=2\Gamma\cos\beta/d\rho g \quad (1)$$

For example, when the liquid 91 is methyl ethyl ketone, if d=0.5 mm, h is about 5 mm. From this fact, when the interval L1 in FIG. 7 is 0.5 mm, the interval L3 may be set to 5 mm or lower. This is a numerical value derived from experiments.

In this embodiment, since the gas-liquid outflow tube 52 is cylindrical but not flat, a portion wider in the interval L1 of a portion where the liquid is held is generated. Since the holding force of the liquid is weakened in this portion, if the interval L3 is set to about 3 mm, the gas-liquid separation can be performed regardless of the installation posture of the gas-liquid separator 22, which has been proved through the experiments. The performance of the gas-liquid separation is stabilized by setting the interval L2 to be equal to or lower than the interval L1.

Figure 9A:
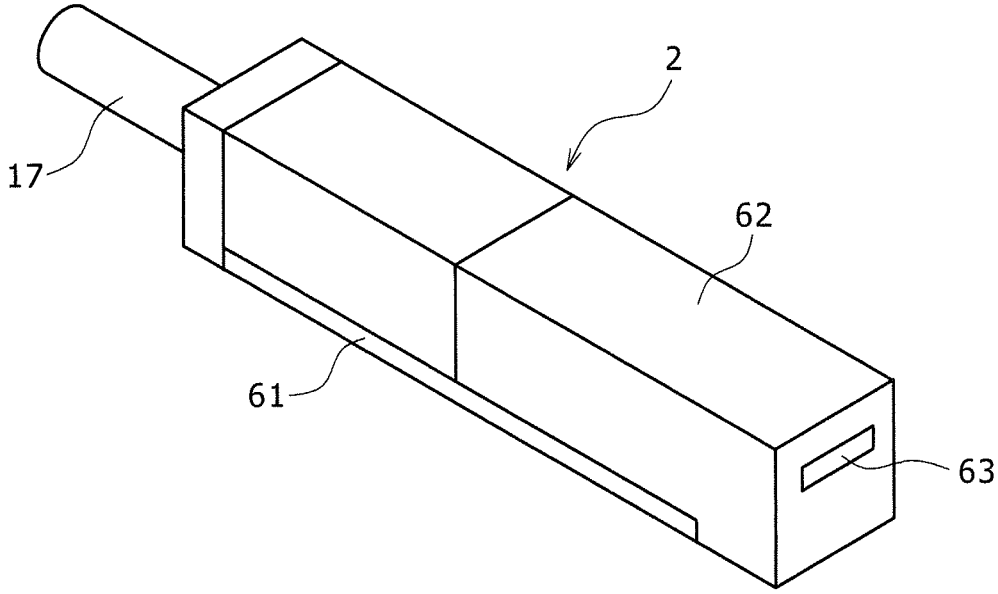
FIG. 9A is a perspective view illustrating an appearance of a recording head.
Figure 9B:
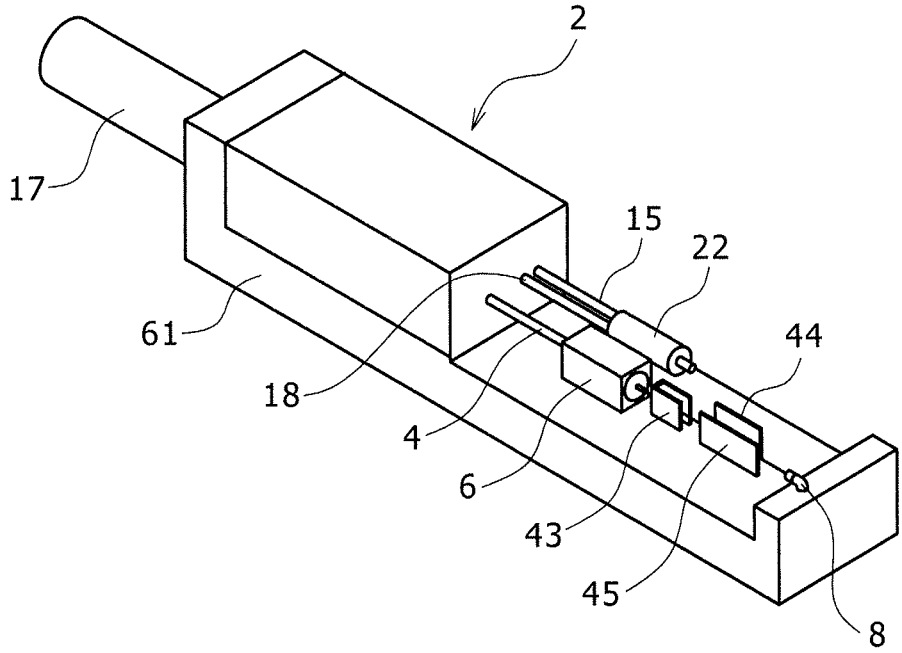
FIG. 9B is a perspective view illustrating a state in which the gas-liquid separator is installed in the recording head.

FIG. 9A is a perspective view illustrating an appearance of the recording head 2, and FIG. 9B is a perspective view illustrating a state in which the gas-liquid separator 22 is installed in the recording head 2. As illustrated in FIG. 9A, the recording head 2 is connected to the conduit 17 connected to the main body 1 (refer to FIG. 1), and referring to FIG. 9B, a cover 62 having a slit 63 is attached to an upper portion of a pedestal 61 having a configuration in which perpendicular plates are arranged on both ends of a flat plate in a longitudinal direction thereof. As illustrated in FIG. 9B, the gas-liquid separator 22 connected with the exhaust path 15 and the separated ink recovery path 18 is arranged on a flat surface of the pedestal 61 along the gas-liquid flowing direction, within the cover 62. The nozzle 6 connected with the ink supply path 4 is installed together with the gas-liquid separator 22 side by side, and the electrification electrode 43, the pair of the upper deflection electrode 44 and the ground electrode 45, and the gutter 8 are installed on a tip side of the nozzle 6 in the stated order.

Therefore, the ink particles 7 that have been ejected from the nozzle 6, and passed through the electrification electrode 43, the upper deflection electrode 44, and the ground electrode 45 are discharged from the slit 63 to conduct printing on the recording medium 46 as illustrated in FIG. 2. Also, the exhaust tube 53 (refer to FIG. 5) of the gas-liquid separator 22 faces in the gutter 8 direction so that the exhaust gas is easily sucked into the gutter 8.

Figure 10:
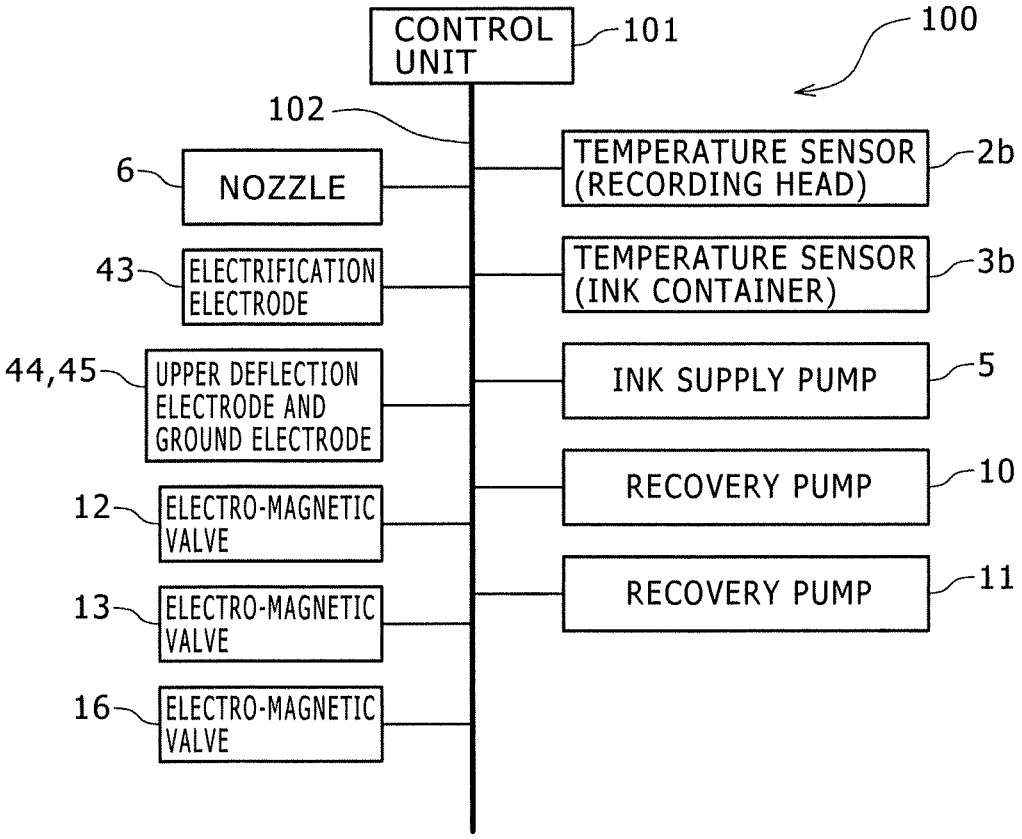
FIG. 10 is a block diagram illustrating a connection configuration of a control unit to controlled elements.

Further, the inkjet recording device 100 includes a control unit 101 illustrated in FIG. 10. FIG. 10 is a block diagram illustrating a connection configuration of the control unit to controlled elements. The control unit 101 is connected through a bus 102 to the respective elements of the nozzle 6, the electrification electrode 43, the upper deflection electrode 44, the ground electrode 45, the electro-magnetic valves 12, 13, 16, a temperature sensor 2*b* of the recording head 2, a temperature sensor 3*b* of the ink container 3, the ink supply pump 5, and the recovery pumps 10, 11. The control unit 101 controls those elements.

Figure 11:
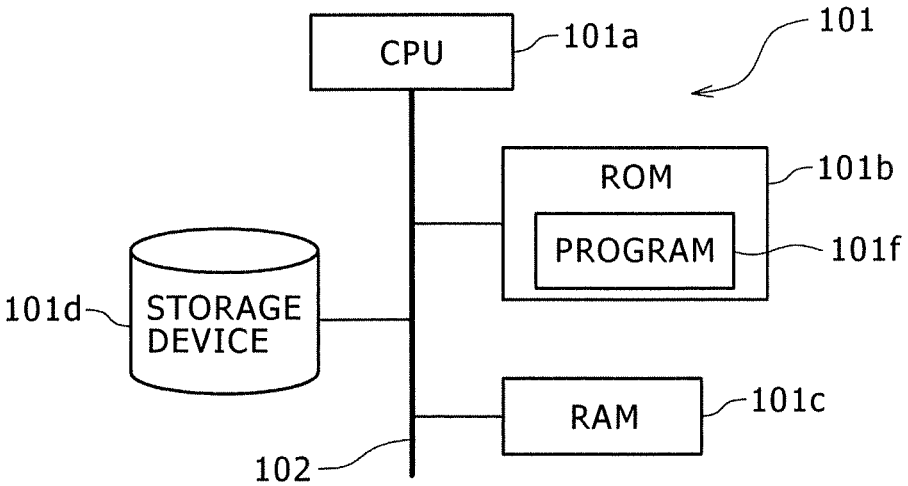
FIG. 11 is a block diagram illustrating a configuration of the control unit.

FIG. 11 is a block diagram illustrating a configuration of the control unit. That is, as illustrated in FIG. 11, the control unit 101 includes a CPU (central processing unit) 101*a*, a ROM (read only memory) 101*b*, a RAM (random access memory) 101*c*, and a storage device (HDD: hard disc drive, etc.) 101*d*. The control unit 101 has a general configuration in which those elements 101*a* to 101*d* are connected to the bus 102. For example, the CPU 101*a* executes a program 101*f* written in the ROM 101*b* to realize a variety of controls which have been described above or will be described below.

<Operation of Embodiment>

The control of the printing operation of the ink jet recording device 100 configured as described above is realized by the control unit 101 as follows.

Figure 12:
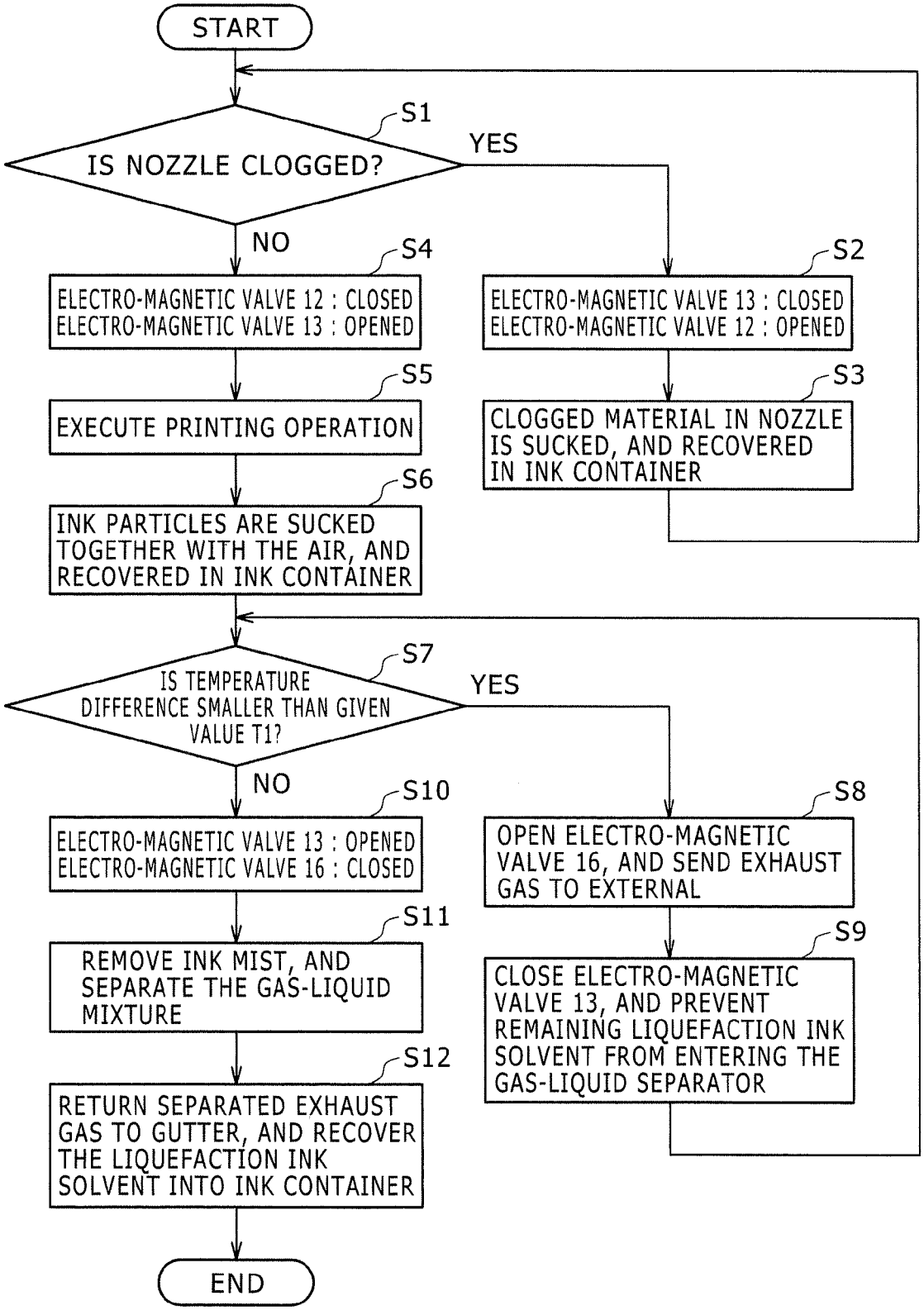
FIG. 12 is a flowchart illustrating the control of ink jet recording operation by the control unit of the ink jet recording device according to this embodiment.

FIG. 12 is a flowchart illustrating the control of ink jet recording operation by the control unit 101 of the ink jet recording device 100.

First, in the ink jet recording device 100 illustrated in FIG. 1, when the printing operation starts, it is determined whether the nozzle 6 is clogged, or not, in Step S1. As a result, if it is determined that the nozzle 6 is clogged, the electro-magnetic valve 13 is closed, and the electro-magnetic valve 12 is opened in Step S2. In Step S3, a clogged material in the nozzle 6 is sucked into the cleaning path 14 by a suction of the recovery pump 11, and recovered to the ink container 3. After this recovery, a flow returns to the determination in Step S1.

On the other hand, if it is determined that the nozzle 6 is not clogged, the electro-magnetic valve 12 is closed, and the electro-magnetic valve 13 is opened in Step S4, and the printing operation is executed in Step S5. That is, the ink 3*a* within the ink container 3 is supplied to the nozzle 6 while being pumped by the ink supply pump 5 through the ink supply path 4. The ink is ejected from the orifice of the nozzle 6 by this supply, split into the particles illustrated in FIG. 2 while flying, and charged with the electrification electrode 43 into the ink particles 7. The ink particles 7 are deflected while passing through an electrostatic field between the upper deflection electrode 44 and the ground electrode 45, and attached onto the recording medium 46 to print characters or images.

During the above printing operation, in Step S6, the ink particles 7 are sucked together with the air from the gutter 8 by the aid of the suction of the recovery pump 10 through the ink recovery path 9 illustrated in FIG. 1.

In Step S7, it is determined whether a temperature difference obtained by subtracting the temperature of the recording head 2 from the temperature of the ink container 3 is smaller than a predetermined value (given value) T1, or not. A detected temperature of the temperature sensor 2*b* installed in the recording head 2 is subtracted from a detected temperature of the temperature sensor 3*b* installed in the ink container 3. Then, whether the temperature difference which is the subtraction result is smaller than the given value T1, or not is determined in comparison. As a result, if it is determined to be smaller, the electro-magnetic valve 16 is opened in Step S8, and the exhaust gas discharged from the ink container 3 through the exhaust path 15 is discharged to the external through the bypass path 19.

At the same time, in Step S9, the electro-magnetic valve 13 is also closed to prevent the liquefaction ink solvent 72 remaining within the exhaust path 15 from entering the gas-liquid separator 22. After the electro-magnetic valve 13 has been closed, the flow returns to Step S7 to conduct the above determination.

Incidentally, when a sufficient time is not elapsed after the ink jet recording device 100 has started the operation, it is determined that the temperature difference is smaller than the given value T1 as described above. In this case, the temperature within the main body 1 has not yet been raised, the temperature difference between the ink container 3 and the recording head 2 is small, and the amount of ink solvent which is liquefied from the mixture exhaust gas that moves from the ink container 3 to the recording head 2 within the exhaust path 15 is small.

If the amount of ink solvent thus liquefied is small, since the liquid holding part 31 of the ink mist mixture unit 21 is not sufficiently wetted, there is a risk that the ink mist 71 is firmly fixed to the liquid holding part 31. For that reason, if it is determined that the temperature difference is smaller than the given value T1, the control is conducted as in Step S8 so that the electro-magnetic valve 16 is opened to feed the exhaust gas to the bypass path 19 to prevent the exhaust gas from flowing into the ink mist mixture unit 21. At the same time, as in Step S9, the electro-magnetic valve 13 is also closed to prevent the liquefaction ink solvent 72 remaining within the exhaust path 15 from entering the gas-liquid separator 22.

On the other hand, in Step S7, it is assumed that it is determined that the temperature difference is equal to or larger than the given value T1. It is determined that the temperature difference is equal to or larger than the given value T1 when the temperature within the main body 1 is raised because several hours are lapsed after the ink jet recording device 100 has started the operation.

In this case, in Step S10, the electro-magnetic valve 13 is opened, and the electro-magnetic valve 16 is closed. With this operation, in Step S11, the mixture exhaust gas (gas-liquid mixture) discharged from the ink container 3 through the exhaust path 15 is fed to the ink mist mixture unit 21 and the gas-liquid separator 22. With this feeding, the ink mist 71 (refer to FIG. 3) is first removed from the gas-liquid mixture by the ink mist mixture unit 21. Then, the gas-liquid mixture after removal of the ink mist 71 is separated into the liquefaction ink solvent 72 (refer to FIG. 3) and the exhaust gas including only the gas by the gas-liquid separator 22. In Step S12, the separated exhaust gas is returned to the gutter 8, and the liquefaction ink solvent 72 is sucked by the recovery pump 11 through the separated ink recovery path 18, and recovered into the ink container 3.

<Advantages of Embodiment>

Thus, according to the ink jet recording device 100 of this embodiment, the ink particles 7 that are unused for printing when the supply ink from the ink container 3 is ejected from the nozzle 6, and printing is conducted on the object to be printed is sucked by the gutter 8 together with the air, and the ink and the air are recovered into the ink container 3. In this situation, the air recovered together with the ink solvent is discharged as the exhaust gas from the ink container 3 by the exhaust path 15. At this time, the liquefaction ink solvent liquefied within the exhaust path 15 is held by the aid of the capillary action, and separated from the exhaust gas including only the gas in the gas-liquid separator 22 to recover the separated liquefaction ink solvent into the ink container 3.

The gas-liquid separator 22 includes the cylindrical gas-liquid inflow tube 51 that is connected to the exhaust path 15, the cylindrical gas-liquid outflow tube 52 that is connected to the separated ink recovery path 18, the cylindrical exhaust tube 53 that discharges the exhaust gas containing only the gas, and the cases 54, 55 having the internal chamber 56 in which the gas-liquid inflow tube 51 and the gas-liquid outflow tube 52 are inserted in parallel from one direction of the external, and the exhaust tube 53 is inserted from the other direction opposite to the one direction, within the chamber 56. The case 54 is formed with the step 58 having the predetermined interval L2 between an end surface and an opening end, on the end surface of a portion into which the exhaust tube 53 is inserted, which faces the opening end of the gas-liquid outflow tube 52, and the gap 57 having the predetermined interval L1 is formed between the inner wall of the case 55 and the outer periphery of the gas-liquid outflow tube 52.

The ink solvent liquefied within the exhaust path 15 can therefore be appropriately separated from the exhaust gas including only the gas by the gas-liquid separator 22. In the related art, since the liquid component that has dropped by the gravity is recovered when separating the gas and the liquid from each other, the gas and the liquid cannot be separated from each other when the installation direction of the gas-liquid separator is changed. However, in the gas-liquid separator 22 according to this embodiment, since the liquid component is held by the capillary action, and separated from the gas, the gas and the liquid can be appropriately separated from each other even if the installation direction of the gas-liquid separator 22 is changed.

Also, the ink jet recording device according to this embodiment further includes the ink mist mixture unit 21 that mixes the ink mist mixed with the exhaust gas within the exhaust path 15, with the liquefaction ink solvent liquefied within the exhaust path 15, and the ink mist mixture unit 21 is installed upstream of the gas-liquid inlet of the gas-liquid separator 22. Further, the ink mist mixture unit 21 and the gas-liquid separator 22 are arranged within the recording head that houses the nozzle 6 and the gutter 8 therein. Therefore, since the fine ink mist included in the exhaust gas can be removed by the ink mist mixture unit 21, the liquefaction ink solvent is further separated into the exhaust gas including only the gas by the gas-liquid separator 22 at the downstream thereof. When this exhaust gas returns to the interior of the recording head 2 since the exhaust gas includes only the air, the interior of the recording head 2 can be prevented from being dirtied.

Also, the ink mist mixture unit 21 includes the liquid holding part 31 containing the liquefaction ink solvent therein, and the filter 32 that catches the fine material generated from the liquid holding part 31.

In the related art, since the ink mist is removed by the solution, time and effort that the solution in which the ink mist component remains must be regularly replaced with fresh one are required, and the expensive running costs occur. On the contrary, according to this embodiment, if the removed ink mist and fine material of the amount that prevents the removal of the ink mist, or larger are accumulated in the liquid holding part 31 or the filter 32, the liquid holding part 31 or the filter 32 has only to be replaced with a fresh one. Therefore, the time and effort are not required, and the running costs can be reduced.

Also, since the outlet of the exhaust gas separated by the gas-liquid separator 22 is faced toward the gutter 8, the exhaust gas can be efficiently recovered.

Also, the ink jet recording device according to this embodiment includes the sensors 2*b* and 3*b* that measures the temperature of the ink container 3 and the temperature within the recording head 2, and the bypass path 19 that is branched from and connected to the exhaust path 15 through the electro-magnetic valve 16, and discharges the exhaust gas flowing in the exhaust path 15 to the external when opening the electro-magnetic value 16. The electro-magnetic valve 16 is opened when the temperature difference obtained by subtracting the temperature within the recording head 2 from the temperature of the ink container 3, which are measured by the sensors 2*b* and 3*b*, is smaller than a predetermined value T1.

For example, when a sufficient time is not elapsed after the ink jet recording device 100 has started the operation, the temperature within the main body 1, that is, the temperature of the ink container 3 has not yet been raised. Therefore, the temperature difference between the ink container 3 and the recording head 2 is small, and the amount of ink solvent which is liquefied from the mixture exhaust gas that moves from the ink container 3 to the recording head 2 within the exhaust path 15 is small. Therefore, the electro-magnetic valve 16 is opened, and the exhaust gas is discharged from the bypass path 19 toward the external, the effective operation of the ink jet recording device 100 can be conducted.

<Modification 1>

Incidentally, when the environmental temperatures of the installation location are represented by the following first to third environments, the ink jet recording device 100 needs the operation control according to the environments. A first environment is that the environmental temperature is a low temperature of about 0 to 10° C. In this case, even a time is elapsed since the operation starts, the temperature difference between the ink container 3 and the recording head 2 is only about 10° C., the amount of liquefaction of the ink solvent within the exhaust path 15 is small, and the liquid holding part 31 of the ink mist mixture unit 21 which is installed upstream of the gas-liquid separator 22 is not sufficiently wetted. For that reason, since there is a risk that the ink mist is firmly fixed to the liquid holding part 31, the control is conducted in this case so that the electro-magnetic valve 16 is opened to feed the exhaust gas to the bypass path 19 so that the exhaust gas is prevented from flowing into the ink mist mixture unit 21 and the gas-liquid separator 22. Also, the control is conducted so that the electro-magnetic valve 13 is also closed, and the liquefaction solvent remaining in the exhaust path 15 is prevented from entering the gas-liquid separator 22. In order to implement this control, a temperature indicator is installed in the vicinity of the ink container 3, and the operation control is conducted according to the temperature information.

A second environment is a case in which the temperature difference between the temperature of the ink container 3 and the temperature of the recording head 2 is small. For example, there is a case in which a place where the main body 1 is installed is effective in air conditioning, but a print position where the recording medium 46 is present is ineffective in the air conditioning. In this case, even if the operation is conducted for a long time, the temperature of the main body 1 is not much raised, and the temperature difference is small. Therefore, there is required a control for opening the electro-magnetic valve 16 and closing the electro-magnetic valve 13. In order to implement this control, the temperature sensors 3*b* and 2*b* are installed in the vicinity of the ink container 3, and in the recording head 2, respectively, to conduct the operation control according to the detected temperatures thereof.

A third environment is a case in which printing is conducted on the warm recording medium 46. In this case, only the recording head 2 is arranged at a warm position and becomes high temperature. For that reason, since the recording head 2 becomes high temperature, even if the ink container 3 is warmed by the operation for a long time, there occurs a phenomenon that the recording head 2 becomes higher in the temperature, or the temperature difference between the recording head 2 and the ink container 3 is substantially eliminated, or becomes small. In the case of this temperature difference, as described above, the control is conducted so that the electro-magnetic valve 16 is opened to feed the exhaust gas to the bypass path 19 to prevent the exhaust gas from flowing into the ink mist mixture unit 21. At the same time, the control is conducted so that the electro-magnetic valve 13 is also closed, and the liquefaction ink solvent 72 remaining in the exhaust path 15 is prevented from entering the gas-liquid separator 22. Accordingly, the ink mist mixture unit 21 and the gas-liquid separator 22 are not used.

Figure 13:
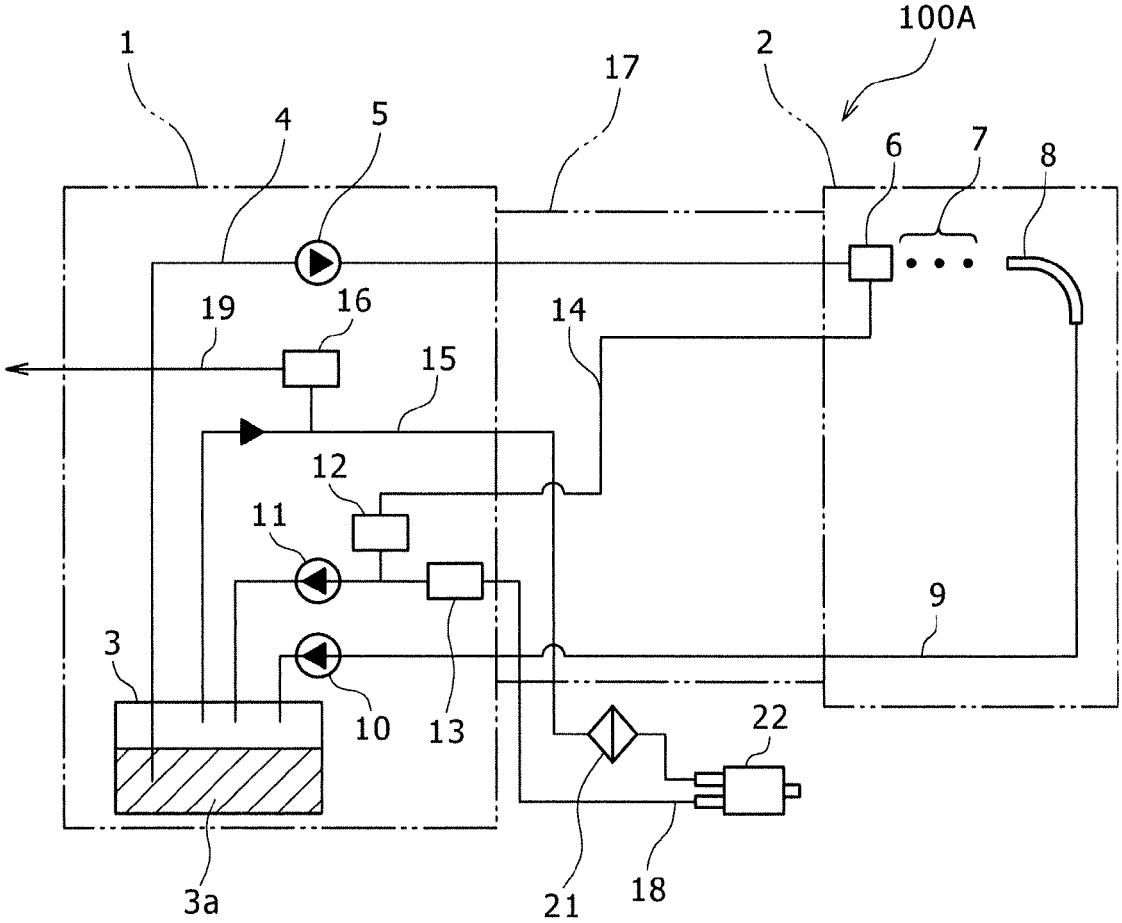
FIG. 13 is a diagram illustrating another configuration of the ink jet recording device according to an embodiment of the present invention.
Figure 14:
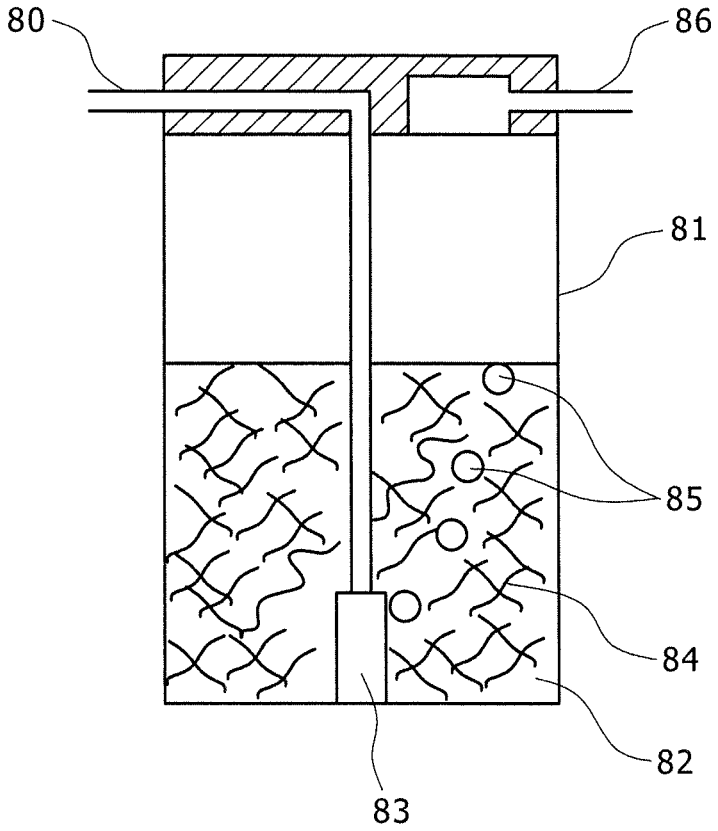
FIG. 14 is a diagram illustrating a method of removing an ink mist contained in an exhaust gas from an ink container in a related-art ink jet recording device.

FIG. 13 is a diagram illustrating another configuration of the ink jet recording device according to an embodiment of the present invention. As in an ink jet recording device 100A illustrated in FIG. 13, the ink mist mixture unit 21 and the gas-liquid separator 22 are not installed within the recording head 2, but arranged outside the main body 1. In this configuration, a length of the exhaust path 15 is equal to that in the above case in which the gas-liquid separator 22 is installed within the recording head 2. Further, a temperature sensor (not shown) that measures the temperature of the gas-liquid separator 22 is provided.

In this configuration, when the temperature difference obtained by subtracting the temperature of the gas-liquid separator 22 from the temperature of the ink container 3 becomes the given value T1 or more by operating the ink jet recording device 100A for a long time, the electro-magnetic valve 13 is opened, and the electro-magnetic valve 16 is closed. Then, the gas-liquid mixture discharged from the ink container 3 through the exhaust path 15 enters the ink mist mixture unit 21, and in the ink mist mixture unit 21, the ink mist 71 (refer to FIG. 3) is removed from the gas-liquid mixture. Then, the gas-liquid mixture after the removal of the ink mist 71 is separated into the liquefaction ink solvent 72 (refer to FIG. 3) and the exhaust gas including only the gas, the exhaust gas discharged to the external of the main body 1 and the recording head 2, and the liquefaction ink solvent 72 is recovered into the ink container 3 through the separated ink recovery path 18.

<Modification 2>

As illustrated in FIG. 6A, the gas-liquid separator 22 forms the gap 57 having the distance L1 between the outer peripheral surface of the cylindrical gas-liquid outflow tube 52 having the circular cross-section and the inner peripheral surface of the case 55, and the liquefaction ink solvent 72 is sucked and held into the gap 57 by the capillary action. In this situation, the gas-liquid outflow tube 52 is formed into the cylinder having the circuit cross-section. However, the gas-liquid outflow tube 52 is formed into a cylinder having an elliptical cross-section, and a larger area faces the inner peripheral surface of the case 55 at the distance L1, and an area of the faced gap 57 becomes larger. Therefore, a larger amount of liquefaction ink solvent 72 can be held as much. Accordingly, the liquefaction ink solvent 72 can be more efficiently sucked from the gas-liquid mixture flowing in the gas-liquid inflow tube 51 to be separated from the exhaust gas.

<Modification 3>

If a plurality of grooves is formed on a surface of the gas-liquid outflow tube 52 facing the inner peripheral surface of the case 55 with the gap L1 along the longitudinal direction of the gas-liquid outflow tube 52, the liquefaction ink solvent 72 can be held in the grooves. Therefore, a larger amount of liquefaction ink solvent 72 can be efficiently held. Therefore, the liquefaction ink solvent 72 can be more efficiently sucked from the gas-liquid mixture, and separated from the exhaust gas.

The present invention is not limited to the above embodiments, but includes a variety of modifications. For example, in the above-mentioned embodiments, in order to easily understand the present invention, the specific configurations are described. However, the present invention does not always provide all of the configurations described above. Also, a part of one configuration example can be replaced with another configuration example, and the configuration of one embodiment can be added with the configuration of another embodiment. Also, in a part of the respective configuration examples, another configuration can be added, deleted, or replaced.

Also, parts or all of the above-described respective configurations, functions, processors (control units), and processing means may be realized by a hardware by being designed, for example, as an integrated circuit. Also, the above respective configurations and functions may be realized by allowing the processor to interpret and execute programs for realizing the respective functions. That is, the respective configurations and functions may be realized by software. The information on the program, table, and file for realizing the respective functions can be stored in a storage device such as a memory, a hard disc, or an SSD (solid state drive), or a storage medium such as an IC (integrated circuit) card, an SD (secure digital memory) card, or a DVD (digital versatile disc).

Also, the control lines and the information lines necessary for description are illustrated, and all of the control lines and the information lines necessary for products are not illustrated. In fact, it may be conceivable that most of the configurations are connected to each other.

What claimed is:

1. An ink jet recording device, comprising:

an ink container that stores an ink therein;

a nozzle that ejects the ink, and conducts printing on an object to be printed;

an ink supply pump that supplies the ink to the nozzle from the ink container through an ink supply path;

a gutter that sucks the ink ejected from the nozzle and not used for the printing together with an air;

a first recovery pump that feeds the ink sucked by the gutter to the ink container through an ink recovery path together with the air to recover the ink;

an exhaust path that exhausts the air mixed with an ink solvent and is recovered in the ink container from the ink container as the exhaust gas;

a gas-liquid separator that holds a liquefaction ink solvent in which the ink solvent in the exhaust gas is liquefied within the exhaust path by a capillary action to separate the liquefaction ink solvent from the exhaust gas containing only the gas; and a second recovery pump that feeds the liquefaction ink solvent separated by the gas-liquid separator to the ink container through a separated ink recovery path;

wherein the gas-liquid separator includes:

a cylindrical gas-liquid inflow tube that is connected to the exhaust path;

a cylindrical gas-liquid outflow tube that is connected to the separated ink recovery path;

a cylindrical exhaust tube that discharges the exhaust gas containing only the gas; and a case having an internal chamber in which the gas-liquid inflow tube and the gas-liquid outflow tube are inserted in parallel from one direction of the external, and the exhaust tube is inserted from the other direction opposite to the one direction, through the chamber, wherein the case is formed with a step having a predetermined interval L2 between an end surface and an opening end, on the end surface of a portion into which the exhaust tube is inserted, which faces the opening end of the gas-liquid outflow tube, and a gap having a predetermined interval L1 is formed between an inner wall of the case and an outer periphery of the gas-liquid outflow tube.

2. The ink jet recording device according to claim 1, wherein the gas-liquid outflow tube is cylindrically formed with an elliptical shape in a cross section, and a surface of the elliptical shape, which is larger in area, faces the inner wall of the case.

3. The ink jet recording device according to claim 1, wherein the gas-liquid outflow tube has a plurality of grooves formed on a surface facing the inner wall of the case along a path direction of the separated ink recovery path.

4. The ink jet recording device according to claim 1, further comprising:

an ink mist mixture unit that mixes an ink mist mixed with the exhaust gas within the exhaust path, with a liquefaction ink solvent liquefied within the exhaust path, wherein the ink mist mixture unit is installed upstream of a gas-liquid inlet of the gas-liquid separator.

5. The ink jet recording device according to claim 4, wherein the ink mist mixture unit includes a liquid holding part containing the liquefaction ink solvent therein, and a filter that catches a fine material generated from the liquid holding part, and wherein the liquid holding part and the filter are joined together so that the filter is arranged at the gas-liquid separator side.

6. The ink jet recording device according to claim 5, wherein an outlet that discharges the exhaust gas separated by the gas-liquid separator is arranged toward the gutter.

7. The ink jet recording device according to claim 6, further comprising:

a sensor that measures a temperature of the ink container and a temperature within the recording head;

a bypass path that is branched from and connected to the exhaust path through an electro-magnetic valve, and discharges the exhaust gas flowing in the exhaust path to an external when opening the electro-magnetic value; and a control unit that controls the electro-magnetic valve to be opened when a temperature difference obtained by subtracting the temperature within the recording head from the temperature of the ink container, which are measured by the sensor, is smaller than a predetermined value.

8. The ink jet recording device according to claim 4, wherein the ink mist mixture unit and the gas-liquid separator are arranged within a recording head that houses the nozzle and the gutter therein.

9. The ink jet recording device according to claim 4, wherein the ink mist mixture unit and the gas-liquid separator are arranged outside a main body that houses a recording head that houses the nozzle and the gutter therein, and the ink container.

* * * * *